US009765994B2

(12) United States Patent
Hoos

(10) Patent No.: US 9,765,994 B2
(45) Date of Patent: Sep. 19, 2017

(54) PROCESS AND APPARATUS FOR TRANSFERRING HEAT FROM A FIRST MEDIUM TO A SECOND MEDIUM

(75) Inventor: Frank Hoos, Mijnsheerenland (NL)

(73) Assignee: Heleos Technology GmbH, Zug (CH)

( * ) Notice: Subject to any disclaimer, the term of this patent is extended or adjusted under 35 U.S.C. 154(b) by 1521 days.

(21) Appl. No.: 12/526,670

(22) PCT Filed: Feb. 13, 2008

(86) PCT No.: PCT/EP2008/051746

§ 371 (c)(1),
(2), (4) Date: Sep. 2, 2009

(87) PCT Pub. No.: WO2008/098964

PCT Pub. Date: Aug. 21, 2008

(65) Prior Publication Data

US 2010/0089550 A1 Apr. 15, 2010

(30) Foreign Application Priority Data

Feb. 14, 2007 (EP) ..... 07102399

(51) Int. Cl.
*F01K 11/04* (2006.01)
*F01K 27/02* (2006.01)
(Continued)

(52) U.S. Cl.
CPC ..... *F25B 3/00* (2013.01); *F01K 11/04* (2013.01); *F01K 13/00* (2013.01); *F01K 27/02* (2013.01);
(Continued)

(58) Field of Classification Search
CPC ..... F24J 3/00; F24J 3/003; F28F 13/00; F25B 3/00; F25B 29/00; F25B 23/00; F03G 7/00; F03G 7/08
(Continued)

(56) References Cited

U.S. PATENT DOCUMENTS 2,451,873 A * 10/1948 Roebuck ..... 62/86
3,470,704 A * 10/1969 Kantor ..... 62/115
(Continued)

FOREIGN PATENT DOCUMENTS

DE 3238567 4/1984
DE 19919616 A1 * 1/2000 ..... F25B 3/00
(Continued)

OTHER PUBLICATIONS

Hartenstein, Hans-Ulrich, et al. "The Application of a Low Temperature Selective Catalytic Reduction System for Municipal and Hazardous Waste Combustors." 1996. Proceedings of the 17th Biennial Waste Processing Conference.*
(Continued)

*Primary Examiner* — Laert Dounis
(74) *Attorney, Agent, or Firm* — Fish & Richardson P.C.

(57) ABSTRACT

A process of transferring heat from a first relatively cold medium to a second relatively hot medium features rotating a contained amount of a compressible fluid about an axis of rotation, thus generating a radial temperature gradient in the fluid, and heating the second medium by the fluid in a section of the fluid relatively far from the axis of rotation. An apparatus for carrying out the process includes a gastight drum rotatably mounted in a frame, and a first heat exchanger mounted inside the drum relatively far from the axis of rotation of the drum.

18 Claims, 3 Drawing Sheets

(51) Int. Cl.

| | |
|---|---|
| ***F24J 3/00*** | (2006.01) |
| ***F28F 5/02*** | (2006.01) |
| ***F25B 3/00*** | (2006.01) |
| ***F01K 13/00*** | (2006.01) |

(52) U.S. Cl.
CPC *F24J 3/00* (2013.01); *F28F 5/02* (2013.01); *F25B 2500/01* (2013.01)

(58) Field of Classification Search
USPC ..... 62/401–403, 86; 60/650, 671; 165/121–122, 88–90, 109.1, 178; 122/11
See application file for complete search history.

(56) References Cited

U.S. PATENT DOCUMENTS

| | | | | | |
|---|---|---|---|---|---|
| 3,473,603 | A | * | 10/1969 | Fujie | 165/122 |
| 3,828,573 | A | | 8/1974 | Eskeli | |
| 3,902,549 | A | | 9/1975 | Opfermann | |
| 3,931,713 | A | | 1/1976 | Eskeli | |
| 3,933,008 | A | | 1/1976 | Eskeli | |
| 4,005,587 | A | | 2/1977 | Eskeli | |
| 4,060,989 | A | | 12/1977 | Eskeli | |
| 4,107,944 | A | | 8/1978 | Eskeli | |
| 4,117,695 | A | * | 10/1978 | Hargreaves | 62/86 |
| 4,170,116 | A | * | 10/1979 | Williams | 62/116 |
| 4,285,202 | A | | 8/1981 | Bailly du Bois | |
| 4,360,977 | A | * | 11/1982 | Frohbieter | 34/86 |
| 4,582,128 | A | * | 4/1986 | Jarreby | 165/90 |
| 4,864,826 | A | * | 9/1989 | Lagow | 60/670 |
| 6,041,604 | A | * | 3/2000 | Nicodemus | 60/671 |
| 7,818,978 | B2 | * | 10/2010 | Ducoulombier et al. | 62/513 |
| 2008/0196859 | A1 | * | 8/2008 | Kidwell et al. | 165/45 |
| 2010/0108295 | A1 | * | 5/2010 | Hoos | 165/104.19 |

FOREIGN PATENT DOCUMENTS

| | | | | | |
|---|---|---|---|---|---|
| DE | 102010008325 | A1 | * | 8/2011 | F25B 23/00 |
| EP | 0616182 | A | * | 9/1994 | |
| GB | 1575684 | A | * | 9/1980 | F24J 2/10 |
| JP | 48052045 | | | 7/1973 | |
| JP | 48078759 | | | 10/1973 | |
| JP | 49006288 | | | 1/1974 | |
| JP | 50019046 | | | 2/1975 | |
| JP | 50098367 | | | 8/1975 | |
| JP | 58035399 | | | 3/1983 | |
| JP | 61165590 | | | 7/1986 | |
| JP | 2007536457 | | | 12/2007 | |
| WO | 03/095920 | | | 11/2003 | |
| WO | 2006/119946 | | | 11/2006 | |

OTHER PUBLICATIONS

English Translation of Bschorr (DE 3238567). Apr. 1984.*
European Patent Office; Written Opinion of the International Searching Authority for PCT/EP2008/051746; Jul. 16, 2008; Hijswijk, NL.
European Patent Office; Written Opinion of the International Searching Authority for PCT/EP2008/051752; Apr. 24, 2008; Hijswijk, NL.
Office Action dated Jan. 31, 2011 in corresponding Chinese Application No. 200880003460.2, 8 pages.
Corresponding European App. No. 08708958.7, 99 pages.

* cited by examiner

PROCESS AND APPARATUS FOR TRANSFERRING HEAT FROM A FIRST MEDIUM TO A SECOND MEDIUM

RELATED APPLICATIONS

This application is a 35 U.S.C. §371 national phase of International Application No. PCT/EP2008/051746, entitled "PROCESS AND APPARATUS FOR TRANSFERRING HEAT FROM A FIRST MEDIUM TO A SECOND MEDIUM" filed on Feb. 13, 2008, which claims priority to European Application Serial Number 07102399.8, filed on Feb. 14, 2007.

TECHNICAL BACKGROUND

The invention relates to a process and an apparatus for transferring heat from a first, relatively cold medium to a second, relatively hot medium.

BACKGROUND

In current power plants, work is typically generated by means of a Carnot cycle or "steam cycle," employing a high temperature source and a low temperature source (heat sink). In practice, a high temperature medium, typically superheated steam, is fed to a turbine, which generates work, and is subsequently condensed, (super)heated and once more fed to the turbine. In other words, the difference between the amount of heat contained in the high temperature medium and the amount of heat sunk to the low temperature source is converted into work, in accordance with the first law of thermodynamics.

At higher temperature differences between the high and low temperature sources, more heat can be converted into work and the efficiency of the process improves. Typically, the environment (earth) serves as the low temperature source (heat sink) and the high temperature medium is generated by burning fossil fuels or by nuclear fission.

DE 32 38 567 relates to a device for generating temperature differences for heating and cooling. Under the influence of an external force, a temperature difference is established in a gas. By using centrifugal forces and with gases of high molecular weight, this effect is increased to such an extent that it is of interest for technical use.

WO 03/095920 relates to a method for transmitting heat energy, wherein the heat energy is transmitted into an inner chamber (3) of a rotating centrifuge via a first heat exchanger (4,4a,4b), in which inner chamber (3) a gaseous energy transfer medium is provided, and wherein the heat is discharged from the centrifuge (2) via a second heat exchanger (5; 5a, 5b). The amount of energy used can be reduced substantially by providing the gaseous energy transmission medium inside the rotor (12) in a state of equilibrium and by radially orienting the heat flow in an outward direction. It is essential to the invention underlying WO 03/095920 that convection be prevented (page 2, last sentence).

U.S. Pat. No. 3,902,549 relates to a rotor mounted for high-speed rotation. At its center is located a source of thermal energy whereas at its periphery there is located a heat exchanger. Chambers are provided, accommodating a gaseous material which, depending upon its position in the chambers, can receive heat from the source of thermal energy or yield heat to the heat exchanger.

It is noted that U.S. Pat. No. 4,107,944 relates to a method and apparatus for generating heating and cooling by circulating a working fluid within passageways carried by rotors, compressing said working fluid therewithin and removing heat from said working fluid in a heat removal heat exchanger and adding heat into said working fluid in a heat addition heat exchanger, all carried by said rotors. The working fluid is sealed within, and may be a suitable gas, such as nitrogen. A working fluid heat exchanger is also provided to exchange heat within the rotor between two streams of said working fluid.

U.S. Pat. No. 4,005,587 relates to a method and apparatus for transport of heat from a low temperature heat source into a higher temperature heated sink, using a compressible working fluid compressed by centrifugal force within a rotating rotor with an accompanying temperature increase. Heat is transferred from the heated working fluid into the heat sink at higher temperature, and heat is added into the working fluid after expansion and cooling from a colder heat source. Cooling is provided within the rotor to control the working fluid density, to assist working fluid circulation. Similar methods and apparatuses are known from U.S. Pat. No. 3,828,573, U.S. Pat. No. 3,933,008, U.S. Pat. No. 4,060,989, and U.S. Pat. No. 3,931,713.

WO 2006/119946 relates to device (70) and method for transferring heat from a first zone (71) to a second zone (72) using mobile (often gaseous or vaporous) atoms or molecules (4) in which in one embodiment, the chaotic motion of the atoms/molecules which usually frustrates the transfer of heat by simple molecular motion is overcome by using preferably elongated nanosized constraints (33) (such as a carbon nanotube) to align the atoms/molecules and then subjecting them to an accelerating force in the direction in which the heat is to be transferred. The accelerating force is preferably centripetal. In an alternative embodiment, molecules (4c) in a nanosized constraint may be arranged to transfer heat by means of an oscillation transverse of the elongation of an elongated constraint (40).

For the sake of completeness, it is noted that U.S. Pat. No. 4,107,944 relates to a method and apparatus for generating heating and cooling by circulating a working fluid within passageways carried by rotors, compressing said working fluid therewithin and removing heat from said working fluid in a heat removal heat exchanger and adding heat into said working fluid in a heat addition heat exchanger, all carried by said rotors. The working fluid is sealed within, and may be a suitable gas, such as nitrogen. A working fluid heat exchanger is also provided to exchange heat within the rotor between two streams of said working fluid.

U.S. Pat. No. 4,005,587 relates to a method and apparatus for transport of heat from a low temperature heat source into a higher temperature heated sink, using a compressible working fluid compressed by centrifugal force within a rotating rotor with an accompanying temperature increase. Heat is transferred from the heated working fluid into the heat sink at higher temperature, and heat is added into the working fluid after expansion and cooling from a colder heat source. Cooling is provided within the rotor to control the working fluid density, to assist working fluid circulation.

Similar methods and apparatuses are known from U.S. Pat. No. 3,828,573, U.S. Pat. No. 3,933,008, U.S. Pat. No. 4,060,989, and U.S. Pat. No. 3,931,713.

WO 2006/119946 relates to device (70) and method for transferring heat from a first zone (71) to a second zone (72) using mobile (often gaseous or vaporous) atoms or molecules (4) in which in one embodiment, the chaotic motion of the atoms/molecules which usually frustrates the transfer of heat by simple molecular motion is overcome by using preferably elongated nanosized constraints (33) (such as a carbon nanotube) to align the atoms/molecules and then subjecting them to an accelerating force in the direction in which the heat is to be transferred. The accelerating force is preferably centripetal. In an alternative embodiment, molecules (4c) in a nanosized constraint may be arranged to transfer heat by means of an oscillation transverse of the elongation of an elongated constraint (40).

JP 61165590 and JP 58035388 relate to rotary-type heat pipes. U.S. Pat. No. 4,285,202 relates to industrial processes for energy conversion involving at least one step which consists in acting on the presence of a working fluid in such a manner as to produce either compression or expansion.

SUMMARY

It is one object of the present disclosure to provide a process for efficiently generating a high temperature medium.

To this end, one aspect of the process includes rotating a contained amount of a compressible fluid about an axis of rotation, thus generating a radial temperature gradient in the fluid, and heating the second medium by the fluid in a section of the fluid relatively far from the axis of rotation.

Some embodiments further include extracting heat from, i.e., cooling, the first medium by the fluid in a section at or relatively close to the axis of rotation.

The hot and cold media thus obtained in turn can be employed e.g., to heat or cool buildings or to generate electricity by, for example, a Carnot cycle or "steam cycle."

The efficiency of the process according to the present disclosure can be further increased if segments, defined in radial direction, of the fluid are thoroughly mixed to obtain an at least substantially constant entropy in these segments and thus improved heat conduction within the fluid.

Also, heat conduction and hence efficiency increases with the pressure and density of the fluid. Thus, pressure is preferably in excess of 2 bar (at the axis of rotation), more preferably in excess of 10 bar (at the axis of rotation). The ratio of pressure at the circumference and pressure at the axis of rotation is preferably in excess of 5, more preferably in excess of 8.

The disclosure further relates to an apparatus for transferring heat from a first relatively cold medium to a second relatively hot medium, including a gastight drum rotatably mounted in a frame, and a first heat exchanger mounted inside the drum relatively far from the axis of rotation of the drum, for instance in the inner wall of the drum.

In one aspect of the present disclosure, the apparatus includes a second heat exchanger positioned at or relatively close to the axis of rotation.

In another aspect, the apparatus includes one or more at least substantially cylindrical and co-axial walls, separating, in radial direction, the inside of the drum into a plurality of compartments.

In a further aspect, at least one of the heat exchangers is coupled to a cycle for generating work. The further cycle can include an evaporator or super-heater, which is thermally coupled to the high temperature heat exchanger, a condenser, thermally coupled to the low temperature heat exchanger, and a heat engine. The environment will typically serve as a heat sink, but may also serve a high temperature source, if the operating temperature of the cycle if sufficiently low.

In yet a further aspect, the compressible fluid is a gas and preferably contains or consists essentially of a mono-atomic element having an atomic number (Z)≥18, such as Argon, preferably ≥36, such as Krypton and Xenon.

The invention is based on the insight that, although heat normally flows from a from a higher to a lower entropy and hence from higher to a lower temperature, in a column of an isentropic, compressible fluid positioned in a field of gravity heat also flows from a lower to a higher entropy. In the atmosphere of the earth, this effect reduces the vertical temperature gradient from a calculated 10° C./km to an actual 6.5° C./km. Hydropower is based on the same principle.

A reduced heat resistance further enhances heat flow from a lower to a higher temperature.

In accordance with at least some aspects of the present disclosure, artificial gravity is employed to reduce the length of the column of the compressible fluid, in comparison with a column subjected merely to the gravity of the earth, and the atmosphere is replaced by a gas allowing a much higher temperature gradient in the fluid. Mixing is employed to improve heat conduction within the fluid.

Within the framework of the present invention the term "gradient" is defined as a continuous or stepwise increase or decrease in the magnitude of a property observed in passing from one point to another, e.g., along a radius of a cylinder.

DESCRIPTION OF DRAWINGS

The invention will now be explained in more detail with reference to the drawings, which schematically show a presently preferred embodiment.

Identical parts and parts performing the same or substantially the same function will be denoted by the same numeral.

DETAILED DESCRIPTION

Figure 1:
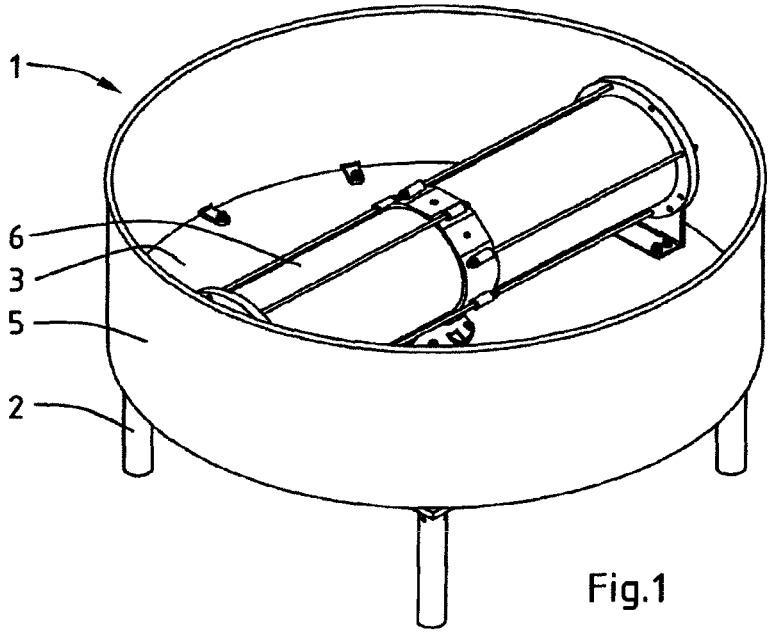
FIGS. 1 and 2 are a perspective view and a side view of a first embodiment of the apparatus.
Figure 2:
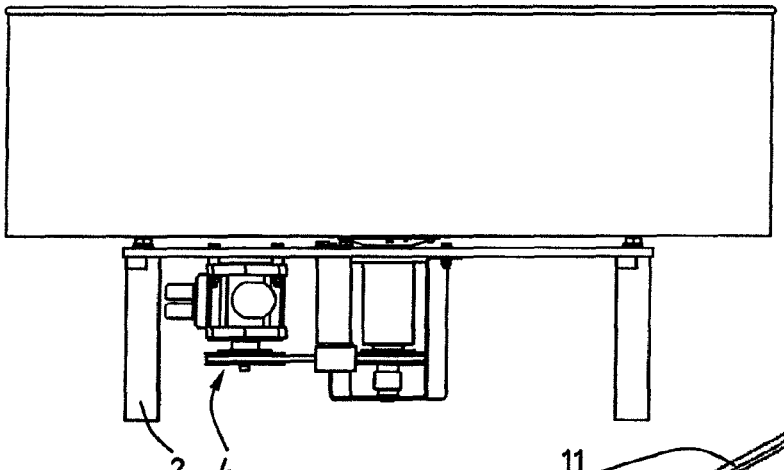

FIG. 1 shows an experimental setup of an artificial gravity apparatus 1. The apparatus 1 comprises a static base frame 2, firmly positioned on a floor, and a rotary table 3, mounted on the base frame 2. Driving means, e.g., an electromotor 4 are mounted in the base frame 2 and are coupled to the rotary table 3. To reduce drag, an annular wall 5 is fastened to the rotary table 3, along its circumference. Further, a cylinder 6 is fastened to the rotary table 3 and extends along a radius thereof.

Figure 3:
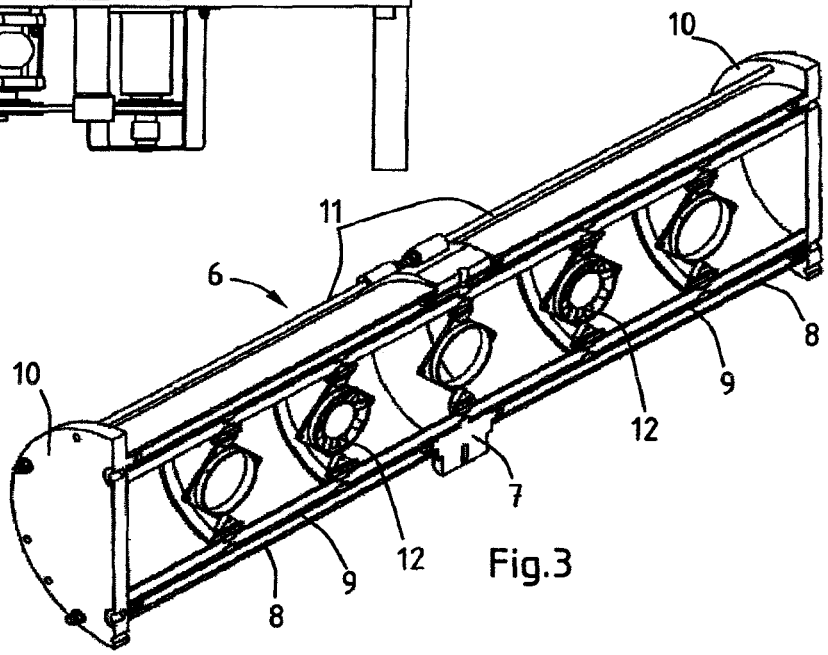
FIG. 3 is a cross-section of a drum used in the embodiment of FIGS. 1 and 2.

As shown in FIG. 3, the cylinder 6 comprises a center ring 7, two (Perspex™) outer cylinders 8, two (Perspex™) inner cylinders 9 mounted coaxially inside the outer cylinders 8, two end plates 10, and a plurality of studs 11, with which the end plates 10 are pulled onto the cylinders 8, 9, and the cylinders 8, 9, in turn, onto the center ring 7. The cylinder 6 has a total length of 1.0 meter. FIG. 3 is to scale.

The lumen defined by the center ring 7, the inner cylinders 9, and the end plates 10, is filled with Xenon, at ambient temperature and a pressure of 1.5 bar, and further contains a plurality of mixers or ventilators 12. Finally, a Peltier element (not shown) is mounted on the inner wall of the ring 7 and temperature sensors and pressure gauges (also not shown) are present in both the ring 7 and the end plates 10.

During operation, the rotary table 3 and hence the cylinder 6 is rotated at a speed of approximately 1000 RPM. Radial segments of the fluid are thoroughly mixed by the ventilators 12, to obtain an at least substantially constant entropy in these segments. In view of the fact that the process is reversible and in view of the thermal isolation provided by the inner and outer cylinders 8, 9, which isolation enables conducting substantially adiabatic processes, heat transfer within the cylinder 6, from the axis of rotation to the circumference and vice versa, is substantially isentropic.

Upon rotation, the temperature and the pressure of the Xenon at the end plates 10 increase and the temperature and pressure at the ring 7 drop. When, upon reaching equilibrium, a stepped heat pulse is fed to the gas at the ring 7 by the Peltier element, temperature and pressure at the ring 7 increase and, subsequently, temperature and pressure at the end plates 10 increase, i.e., heat flows from a source having a relatively low temperature (the gas at the ring) to a source having a relatively high temperature (the gas at the end plates).

Figure 4:
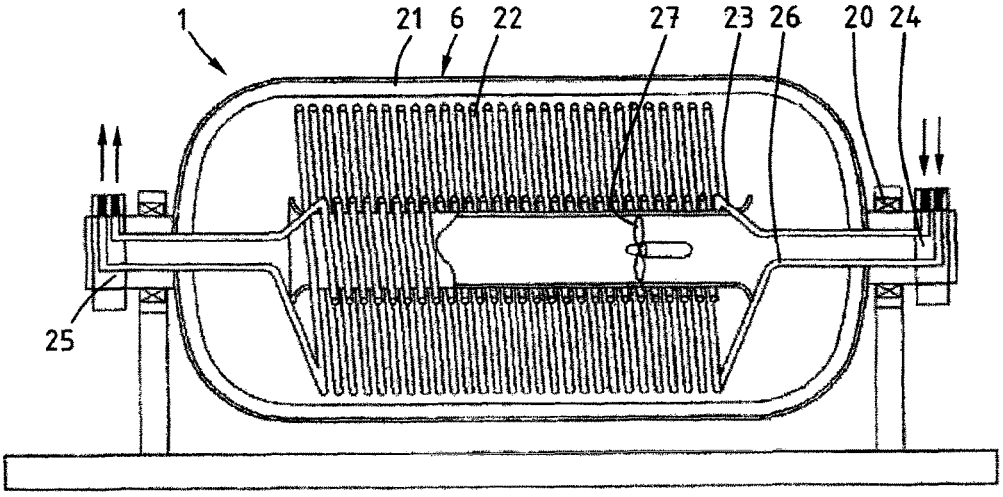
FIG. 4 is a cross-section of a second embodiment of the apparatus.

FIG. 4 is a cross-section of a second artificial gravity apparatus 1. The apparatus 1 comprises a static base frame 2, firmly positioned on a floor, and a rotary drum 6, mounted, rotatable about its longitudinal axis, in the base frame 2, e.g., by suitable bearings, such as ball bearings 20. The drum 6 suitably has a diameter in a range from 2 to 10 meters, in this example 4 meters. The wall of the drum is thermally isolated in a manner known in itself. The apparatus 1 further comprises a driving means (not shown) to spin the drum at rates in a range from 50 to 500 RPM.

The drum 7 contains (at least) two heat exchangers, a first heat exchanger 22 mounted inside the drum relatively far from the axis of rotation of the drum 7 and a second heat exchanger 23 positioned at or relatively close to said axis. In this example, both heat exchangers 22, 23 comprise a coiled tube coaxial with the axis of rotation and connected, via a first rotatable fluid coupling 24, to a supply and, via a second rotatable fluid coupling 25, to an outlet. In some aspects, the drum 7 may have a diameter of at least 1.5 meter and may be rotated at at least 50 RPM.

The embodiment shown in FIG. 4 further comprises a tube 26, coaxial with the longitudinal axis of the drum 6 and containing an axial ventilator 27 to forcedly circulate the contents of the drum 6. In this example, the drum 6 is filled with Xenon at a pressure of 5 bar (at ambient temperature), whereas the heat exchangers 22, 23 are filled with water.

Figure 5:
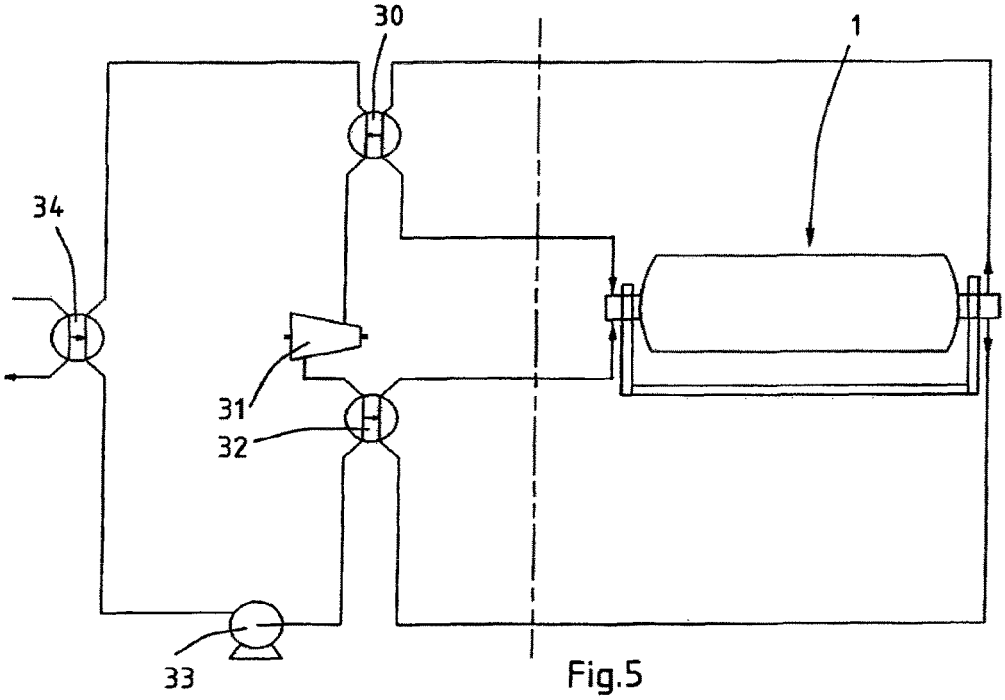
FIG. 5 is a schematic layout of a power plant comprising the embodiment of FIG. 4.
Figure 6:
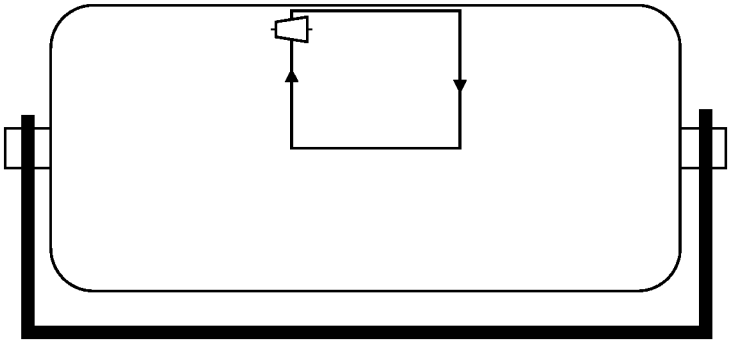
FIG. 6 illustrates an example embodiment that includes a drum, a radially extending tube for holding an additional liquid (not shown), a generator, a tube where the liquid can be subsequently evaporated by the relatively hot compressible fluid at or near the inner wall of the drum, a radially extending tube for transporting the vapor back to the center of the drum and a tube at or near the center of the drum where the vapor can be condensed by the relatively cold compressible fluid.

FIG. 5 is a schematic layout of a power plant comprising the embodiment of FIG. 4, coupled to a cycle for generating work, in this example a so-called "steam cycle." The cycle comprises an super-heater 30, coupled to the high temperature heat exchanger 22 of the apparatus 1, a heat engine, known in itself and comprising, in this example, a turbine 31, a condenser 32 coupled to the first heat exchanger 23 of the apparatus 1, a pump 33, and an evaporator 34. The steam cycle is also filled with water. Other suitable media are known in the art.

Rotating the drum will generate a radial temperature gradient in the Xenon, with a temperature difference ($\Delta T$) between the heat exchangers in a range from 100° C. to 600° C., depending on the angular velocity of the drum. In this example, the drum is rotated at 350 RPM resulting in a temperature difference ($\Delta T$) of approximately 300° C. Water at 20° C. is fed to both heat exchangers 22, 23. Heated steam (320° C.) from the high temperature heat exchanger 22 is fed to the super-heater 30, whereas cooled water (10° C.) from the low temperature heat exchanger 23 is fed to the condenser 32. The steam cycle generates work in a manner known in itself.

In another embodiment, the apparatus comprises two or more drums coupled in series or in parallel. For instance, in configurations comprising two drums in series, the heated medium from the first drum is fed to the low temperature heat exchanger of the second drum. As a result, heat transfer to the high temperature heat exchanger in the second drum is increased considerably, when compared to heat transfer in the first drum. The cooled medium from the first drum can be used as a coolant, e.g., in a condenser.

In another embodiment, and as an alternative or addition to the aforementioned tube (26), the apparatus comprises a plurality of at least substantially cylindrical and co-axial walls, separating the inside of the drum into a plurality of compartments. The fluid in each of the compartments is thoroughly mixed, e.g., by ventilators or static elements, so as to establish a substantially constant entropy within each of the compartments and thus enhance mass transport within each of the compartments. As a result, an entropy gradient, stepwise and negative in outward radial direction, is achieved which enables heat transfer from the axis of rotation of the drum to the circumference of the drum.

The walls mutually separating the compartments may be solid, thus preventing mass transfer from one compartment to the next, or may be open, e.g., gauze- or mesh-like, thus allowing limited mass transfer. The walls may also be provided with protrusions and/or other features that increase surface area and thus heat transfer between compartments.

In yet another embodiment, an additional liquid flows, e.g., inside radially extending tubes, from the center towards the circumference of the drum, thus gaining potential energy and pressure. The high pressure liquid drives a generator, e.g., a (hydro)turbine, and is subsequently evaporated by the relatively hot compressible fluid (e.g., Xenon) at or near the inner wall of the drum. Vapor thus obtained is transported back to the center of the drum, at least partially by employing its own expansion, and condensed by the relatively cold compressible fluid. This embodiment can be used to directly drive a generator.

The invention is not restricted to the above-described embodiments, which can be varied in a number of ways within the scope of the claims. For instance, other media, such as carbon dioxide, hydrogen, and $CF_4$, can be used in the heat exchangers in the drum.

The invention claimed is:

1. A method of transferring heat from a first relatively cold medium to a second relatively hot medium and generating work, the method comprising:

rotating a contained amount of a compressible fluid in a drum about an axis of rotation, forcibly mixing radial segments of the fluid within the drum by at least one axial ventilator arranged in a tube that is arranged in the drum and coaxial with a longitudinal axis of the drum, generating, based on the rotation of the contained amount of the compressible fluid about the axis of rotation, a radial temperature gradient in the fluid, extracting heat from the first medium by the fluid in a second heat exchanger in a section at or relatively close to the axis of rotation and heating the second medium by the fluid in a first heat exchanger in a section of the fluid relatively far from the axis of rotation, where the radial temperature in the fluid increases, based on the forced mixing of segments of the fluid, from the section at or relatively close to the axis of rotation to the section relatively far from the axis of rotation, wherein the first and second heat exchangers are coupled to a cycle for generating work, the cycle comprising:

an evaporator or super-heater that is thermally coupled to the first heat exchanger, a condenser that is thermally coupled to the second heat exchanger, and a heat engine coupled with the evaporator and the condenser, and generating work with the cycle.

2. The method according to claim 1, further comprising circulating the fluid from the section at or relatively close to the axis of rotation to the section relatively far from the axis of rotation and back to the section at or relatively close to the axis of rotation.

3. The method according to claim 1, wherein the compressible fluid is contained in the drum having a diameter of at least 1.5 meter and is rotated at at least 50 RPM.

4. The method according to claim 1, further comprising rotating a contained amount of the compressible fluid about an axis of rotation in at least one of two or more drums and in two or more compartments of the at least one of two or more drums.

5. The method according to claim 1, wherein the compressible fluid contains or consists essentially of a monoatomic element having an atomic number (Z)≥18.

6. A heat transfer apparatus for transferring heat from a first relatively cold medium to a second relatively hot medium, the apparatus comprising:

a gastight drum rotatably mounted in a frame, a first heat exchanger mounted inside the drum relatively far from an axis of rotation of the drum, where the gastight drum is configured to rotate a compressible fluid about the axis of rotation of the drum to generate a radial temperature in the fluid that increases from a section at or relatively close to the axis of rotation to a section relatively far from the axis of rotation, one or more mixers to forcibly mix of segments of the fluid, and a second heat exchanger positioned at or relatively close to the axis of rotation, wherein at least one of the first or second heat exchangers is coupled to a cycle for generating work, the cycle comprising:

an evaporator or super-heater, which is thermally coupled to the first heat exchanger, a condenser, thermally coupled to the second heat exchanger, and a heat engine coupled with the evaporator and condenser.

7. The apparatus according to claim 6, comprising one or more at least substantially cylindrical and co-axial walls, separating the inside of the drum into a plurality of compartments.

8. The apparatus according to claim 6, wherein at least one of the first or second heat exchangers comprises a coiled tube coaxial with the axis of rotation.

9. A method of transferring heat from a first relatively cold medium to a second relatively hot medium, the method comprising:

rotating a contained amount of a compressible fluid about an axis of rotation, thus generating a radial temperature gradient in the fluid, heating the second medium by fluid in a section of the fluid relatively far from the axis of rotation;

allowing an additional liquid to flow away from the axis of rotation, driving a generator with the liquid, evaporating the liquid by the fluid in a section of the fluid relatively far from the axis of rotation, pumping the vapor towards the axis of rotation; and condensing the vapor by the fluid in a section at or relatively close to the axis of rotation.

10. The method according to claim 1, wherein the compressible fluid is at a pressure in excess of 10 bar measured at the axis of rotation.

11. The method according to claim 1, where entropy of the compressible fluid decreases from the section at or relatively close to the axis of rotation to the section relatively far from the axis of rotation.

12. The method according to claim 1, wherein the compressible fluid is at a pressure in excess of 2 bar.

13. The method according to claim 1, wherein the compressible fluid is contained in the drum having a diameter of at least 1.5 meter and is rotated at at least 100 RPM.

14. The method according to claim 1, wherein the cycle comprises a Carnot or steam cycle.

15. The method according to claim 1, wherein the compressible fluid contains or consists essentially of a monoatomic element having an atomic number (Z)≥36.

16. A heat transfer apparatus for transferring heat from a first relatively cold medium to a second relatively hot medium, the apparatus comprising:

a gastight drum rotatably mounted in a frame, and a first heat exchanger mounted inside the drum relatively far from an axis of rotation of the drum, where the gastight drum is configured to rotate a compressible fluid about the axis of rotation of the drum to generate a radial temperature gradient in the fluid and heat the second medium in the first heat exchanger, a second heat exchanger positioned at or relatively close to the axis of rotation, where at least one of the heat exchangers is coupled to a cycle for generating work, the cycle comprising:

an evaporator or super-heater, which is thermally coupled to the first heat exchanger, a condenser thermally coupled to the second heat exchanger, and a heat engine coupled with the evaporator and the condenser.

17. The method according to claim 1, further comprising heating the evaporator or super-heater with heat from the fluid via the first heat exchanger.

18. The method according to claim 1, further comprising cooling the condenser by transferring heat to the fluid via the second heat exchanger.

* * * * *